US006302733B1

(12) United States Patent
Sakaguchi et al.

(10) Patent No.: US 6,302,733 B1
(45) Date of Patent: Oct. 16, 2001

(54) CONNECTOR HAVING WATERPROOF STRUCTURE

(75) Inventors: Tadahisa Sakaguchi; Akira Shinchi, both of Shizuoka-ken (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/359,671

(22) Filed: Jul. 23, 1999

(30) Foreign Application Priority Data

Jul. 24, 1998 (JP) ..... P10-209834

(51) Int. Cl.[7] ..... H01R 13/40
(52) U.S. Cl. ..... 439/587
(58) Field of Search ..... 439/596, 465, 439/466, 467, 460, 942, 587, 589, 936; 29/874, 876, 878; 174/74 R, 77 R

(56) References Cited

U.S. PATENT DOCUMENTS 5,928,033 * 7/1999 Kato et al. ..... 439/587
6,019,628 * 2/2000 Shinchi ..... 439/465
6,142,825 * 11/2000 Shinchi ..... 439/587

FOREIGN PATENT DOCUMENTS 0 851 536 A 7/1998 (EP) .
232 1347 A 7/1998 (GB) .
9-320651 12/1997 (JP) .

* cited by examiner

*Primary Examiner*—Brian Sircus
*Assistant Examiner*—Son V. Nguyen
(74) *Attorney, Agent, or Firm*—Finnegan, Henderson, Farabow, Garrett & Dunner, L.L.P.

(57) ABSTRACT

A connector is provided with waterproof structure. In the structure, a covered wire having a conductor covered with a cover part is connected with a terminal and inserted into a wire insertion hole communicating with a terminal accommodating chamber of a connector body. The waterproof structure is provided by welding the cover part to a connector part defining the wire insertion hole due to ultrasonic oscillating and pressing from outside. The wire insertion hole is provided with a diametrical portion capable of adhering to a cover part of the thinnest wire of the covered wires having differential diameters. Owing to the provision of the diametrical portion, the waterproof structure allows the connector to cope with the covered wires having different diameters.

7 Claims, 8 Drawing Sheets

CONNECTOR HAVING WATERPROOF STRUCTURE

BACKGROUND OF THE INVENTION

1. Field of the Invention

The present invention relates to a waterproof connector which is capable of ensuring waterproof characteristic in spite of the application for covered wires of different diameters.

2. Description of the Related Art

Japanese Unexamined Patent Publication (kokai) No. 9-320651 discloses a conventional waterproof structure for the connector. In the publication, there are shown covered wires each having a conductor covered with a synthetic covering part. In this structure, a pair of upper and lower resinous tips are used for a part of the structure where two covered wires intersect with each other.

The lower resinous tip is provided, at a center portion thereof, with a projecting welding boss and also provided, at the four corners, with guide grooves into which the covered wires are accommodated. Each guide groove has a cover removing part and a waterproof groove part, which are formed along a direction extending from the welding boss toward the outside, in order. There is remained a gap defined between each guide groove and the welding boss.

Similarly to the lower resinous tip, the upper resinous tip has a welding boss formed to project at the center portion and four guide grooves formed on four corners to define gaps between each guide groove and the welding boss. Also in each guide groove, a cover removing part and a waterproof groove part are formed in order.

According to the above-mentioned structure, on condition of setting the lower resinous tip in an amble, the covered wires are inserted into the guide grooves of the lower resinous tip so as to intersect with each other and sequentially, the upper resinous tip is turned over and abutted on the lower resinous tip. This abutment allows both welding bosses of the upper and lower tips to mutually contact with each other and also causes the covered wires to be interposed between the guide grooves. In this state, the resultant assembly is subjected to the ultrasonic oscillation by an ultrasonic horn exerting pressure on the upper tip.

Consequently, the cover parts of the covered wires are molten to enter into the waterproof grooves, so that both conductors are exposed and connected with each other. The further continuation of ultrasonic oscillating under pressure allows both of the welding bosses to be molten and welded to each other. In this state, the waterproof grooves are filled up with the molten resinous material forming the insulating cover parts. Thereafter, as time goes by, the molten material of the cover parts is hardened while fulfilling the waterproof grooves in the form of a ring, whereby the connection having the waterproof characteristic can be provided between the intersecting covered wires.

In this way, the above-mentioned waterproof structure allows the connector to have the waterproof characteristic. That is, according to the conventional structure, the waterproof characteristic is applied on the connector by forming the wire insertion holes of the connector body with the waterproof guide grooves and sequential fulfilling the grooves with the insulating cover parts molten by the ultrasonic oscillation.

However, if the thin covered wire having a small diameter is used for the structure, it is expected that the waterproof capability is not ensured sufficiently since an amount of the molten resin resulting from the ultrasonic oscillation is too little to fulfill the waterproof grooves. Accordingly, the application of the above-mentioned structure is limited to the covered wires having diameters more than a designated thickness disadvantageously.

SUMMARY OF THE INVENTION

Under such a circumstance, it is therefore an object of the present invention to provide a waterproof connector for general purpose, which is capable of ensuring a sufficient waterproof characteristic in spite of the application for covered wires of different diameters.

The object of the present invention described above can be accomplished by a waterproof connector for a plurality of covered wires having conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes is provided with an aperture portion capable of close contact with the cover part of the thinnest one of the covered wires having plural different diameters;

whereby, at least the aperture portion of each of the wire insertion holes, the connector body is welded to the cover parts of the covered wires.

According to the above-mentioned structure, since each wire insertion hole of the connector body has the aperture portions for close contact with the cover part of the thinnest covered wire, it is possible to ensure the close contact of the wire insertion hole with the cover parts of the other covered wires having diameters more than that of the thinnest wire. Consequently, the wire insertion holes can be fitted to all of the covered wires of different diameters. At the aperture portions directed to the cover part of the thinnest wire, there can be realized a situation where the wire insertion holes are coming into close contact with the covered wires of all diameters. Therefore, since the cover parts of the wires are certainly welded to the connector body at the aperture portions, it is possible to ensure the waterproof capacity. That is, it is possible to provide the waterproof connector for general purpose, which is capable of ensuring the sufficient waterproof characteristic in spite of the application for covered wires of different diameters.

According to the second aspect of the invention, in the above-mentioned waterproof structure, each of the wire insertion holes consists of at least two aperture portions of different diameters, the aperture portion of smaller diameter being formed to have a diameter smaller than an outer diameter of the cover part of the thinnest covered wire, the aperture portion of larger diameter being formed to have a diameter equal to or smaller than an outer diameter of the cover part of the thickest covered wire.

In this case, each wire insertion hole is provided with the aperture portion of small diameter in close contact with the cover part of the thinnest covered wire and the aperture portion of large diameter in close contact with the cover part of the thickest covered wire. Further, against the covered wire having a middle thickness between the thinnest and thickest wires, the aperture portion of small diameter is sure to be in close contact with the same wire. Additionally, since the molten material squeezed by the small aperture portion is charged between the large aperture portion and the wire closely, the waterproof capacity of the connector can be improved. Thus, it is possible to provide the connector capable of ensuring the waterproof characteristic in spite of the application for covered wires of different diameters.

According to the third aspect of the invention, in the above-mentioned waterproof structure, each of the wire insertion holes is formed to have a single diameter smaller than an outer diameter of the cover part of the thinnest covered wire.

In this case, the structure of the connector is simplified by its wire insertion holes of the single diameter. Further, since the close contact with the cover part of the thinnest covered wire is ensured by the wire insertion holes, it is possible for the holes to adhere closely to the covered wire having a thickness more than the thinnest covered wire, whereby the waterproof capability can be ensured.

According to the fourth aspect of the invention, in the above-mentioned waterproof structure, each of the wire insertion holes is tapered so as to have diameters which continuously vary from a small diameter, which is smaller than an outer diameter of the cover part of the thinnest covered wire, to a large diameter, which is equal to or smaller than an outer diameter of the cover part of the thickest covered wire, along the axial direction of the covered wire.

Also in this case, since the close contact with the cover part of the thinnest covered wire is ensured by the tapered wire insertion holes, it is also possible for the holes to adhere closely to the covered wire having a thickness more than the thinnest covered wire, whereby the waterproof capability can be ensured.

According to the fifth aspect of the invention, in the above-mentioned waterproof structure, the connector body is provided, in the vicinity of the wire insertion holes, with radiating slots for discharge heat generated at the time of ultrasonic oscillating.

In this case, owing to the provision of the radiating slots, the heat radiation can be accomplished rapidly. Therefore, even if the crystalline resin is used, then it is not crystallized. Thus, it is possible to avoid the solidification of resinous material due to the crystallization and the corresponding reduction in toughness of the resinous material and possible to complete the process for waterproof in a short time.

According to the sixth aspect of the invention, in the above-mentioned waterproof structure, the connector body has a wire cradle, the wire cradle having first welding sides and a plurality of first wire accommodating grooves, and a cover to be overlaid on the wire cradle, the cover having second welding sides to be welded to the first welding sides and second wire accommodating grooves to be agreed with the first accommodating grooves thereby to define the wire insertion holes.

In this case, owing to the provision of the first and second welding sides, it is possible to securely combine the cover with the wire cradle by the ultrasonic welding. Additionally, since each wire insertion hole is defined by the first wire accommodating groove on the wire cradle and the second wire accommodating groove on the cover, the structure allows the covered wire to be inserted into the wire insertion hole with ease.

According to the seventh aspect of the invention, in the above-mentioned waterproof structure of the sixth aspect, the cover is provided, along a thickness direction thereof, with radiating slots for discharge heat generated at the time of ultrasonic oscillating.

In this case, since the radiating slots are formed in the cover covering the wire cradle, the heat radiation can be performed effectively. Moreover, since there is no need to form the slots in the wire cradle, it is possible to prevent the strength of the cradle from being reduced.

These and other objects and features of the present invention will become more fully apparent from the following description and appended claims taken in conjunction with the accompany drawings.

DESCRIPTION OF THE PREFERRED EMBODIMENT

One embodiment of the waterproof structure for the connector will be described with reference to the drawings.

Figure 1:
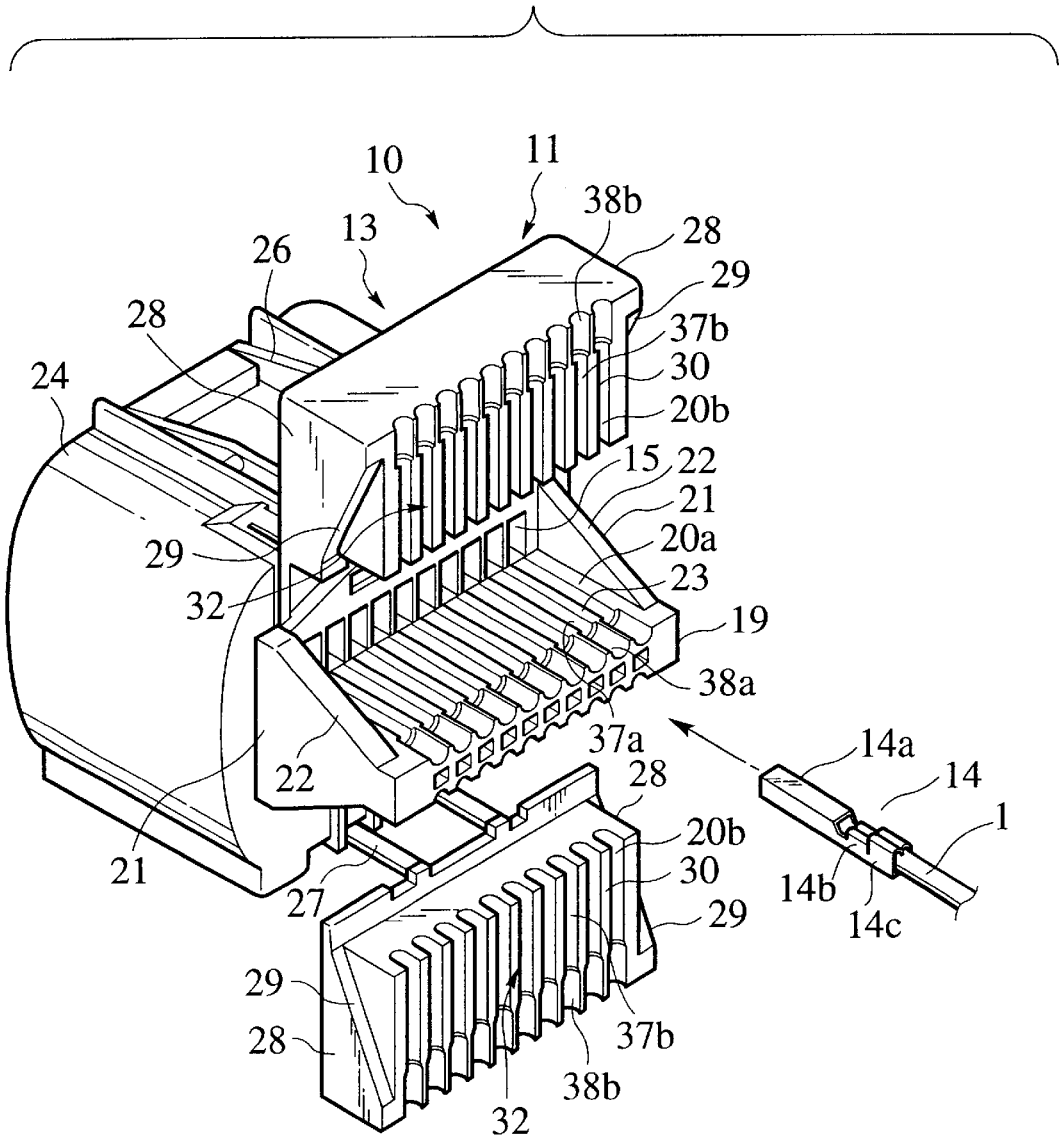
FIG. 1 is an overall perspective view of a waterproof connector in accordance with an embodiment of the present invention.
Figure 2:
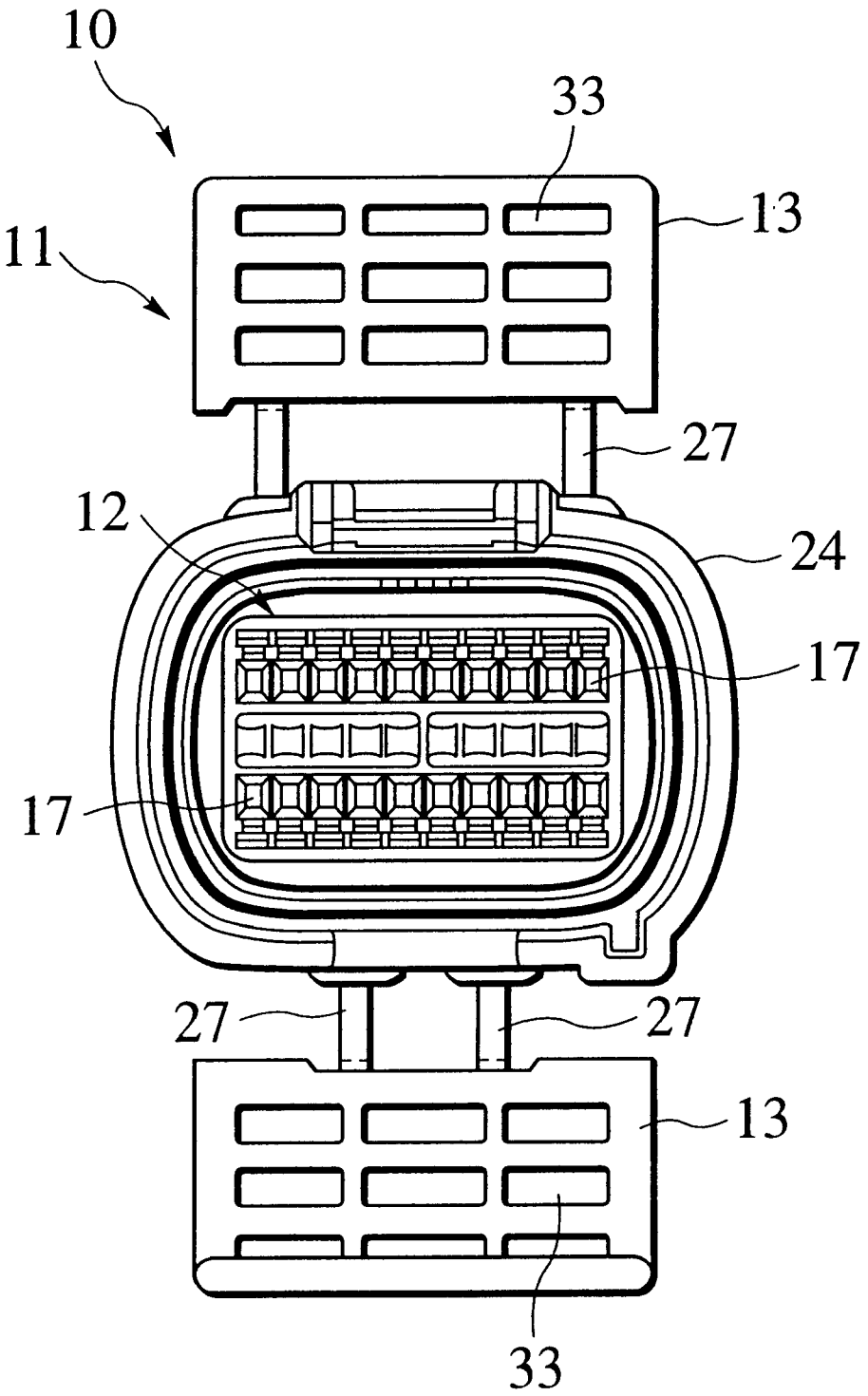
FIG. 2 is a front view of the waterproof connector of the embodiment of the present invention.

As shown in FIGS. 1 and 2, a waterproof connector 10 comprises a connector body 11 consisting of a housing 12 and covers 13. The housing 12 is provided with a plurality of terminal accommodating chambers 15 which stand in high and low ranks in order to accommodate a plurality of terminals 14 therein, respectively. Horizontally formed at the intermediate portion of the housing 12 is a support wall 18 which divides the terminal accommodating chambers 15 into high and low groups.

Figure 5:
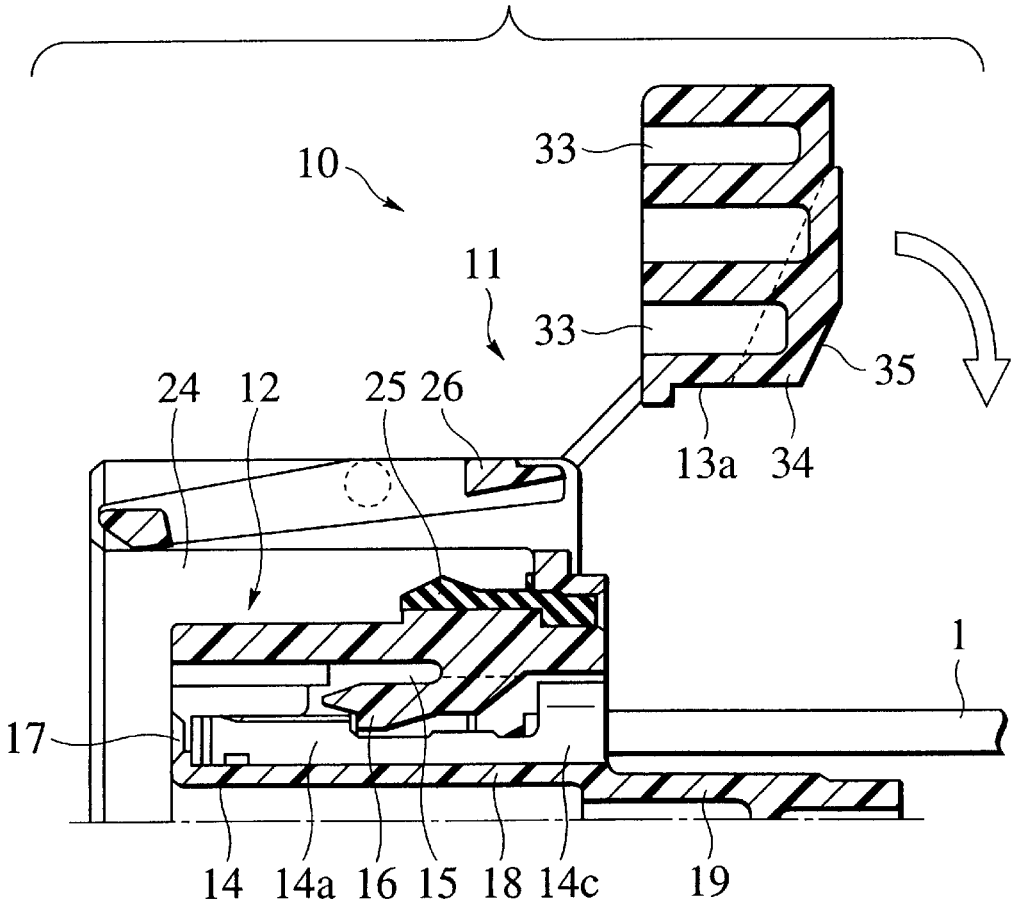
FIG. 5 is a partial cross sectional view showing a condition to accommodate a terminal in a terminal accommodating chamber.
Figure 6:
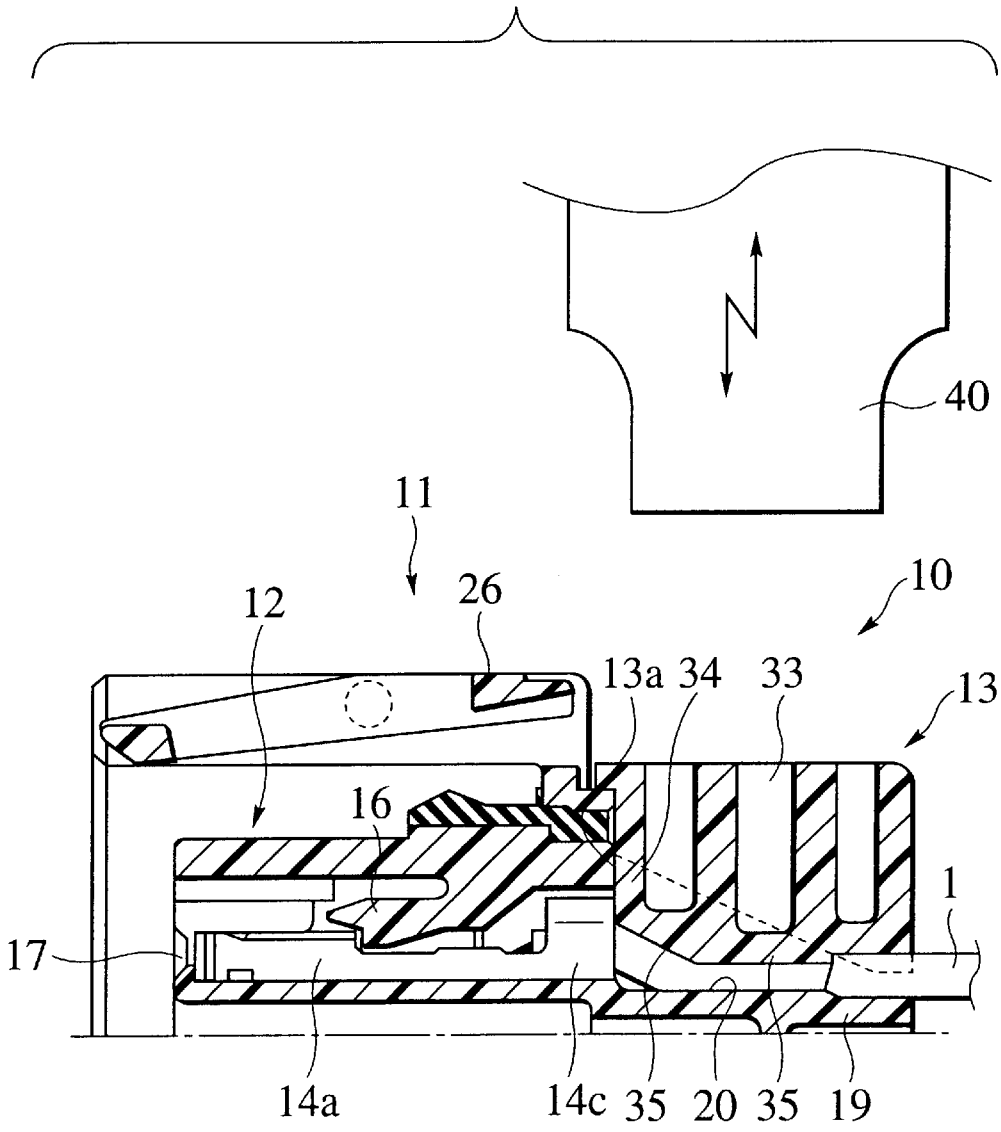
FIG. 6 is a partial cross sectional view showing a condition to carry out the ultrasonic oscillation upon putting a cover on the terminal.

As shown in FIGS. 5 and 6, each terminal accommodating chamber 15 has an engaging lance 16 formed to project therein, for engagement with a contact part 14*a* of the terminal 14 from a rear side thereof. Brought into contact with the contact part 14*a* of the terminal 14 is a not-shown terminal which is to be mated with the terminal 14. At the leading end of each terminal accommodating chamber 15, a terminal insertion hole 17 is opened for allowing the mating terminal to enter therein. The support wall 18 is formed to extend from the terminal accommodating chamber 15 to the rear side, thereby providing a wire cradle 19 mentioned later.

On the outside of the housing 12, a hood part 24 is provided for enclosing the housing 12. The hood part 24 is constituted by a curved body in the form of a rectangular cylinder and provided with an opened front face through which a mating connector (not shown) is to be inserted and fitted into the hood part 24. In order to fix the mating connector being inserted into the hood part 24, it is equipped with a waterproof packing 25. Additionally, on a top face of the hood part 24, a lock arm 26 is provided for locking the mating connector in its engaged condition. Note, the rear face of the hood part 24 is closed except the terminal accommodating chambers 15 and first wire accommodating grooves 20*a* of the wire cradle 19, which will be described later.

As shown in FIG. 1, the wire cradle 19 is rectangular-shaped in plan view and provided, on upper and lower faces thereof, with the first wire accommodating grooves 20*a* communicating with the terminal accommodating chambers 15 correspondingly. Further, on each of the left and right ends of the wire cradle 19, a generally-triangular sidewall 21 is integrally formed so as to succeed the rear face of the hood part 24 and gradually decrease the width as it approaches the rear end of the cradle 19. Each sidewall 21 has upper and lower end faces providing first welding sides 22 which are to be welded to the covers 13 by the ultrasonic oscillation. The wire accommodating grooves 20*a* are defined by the left and right sidewalls 21 and also partition walls 23 which are formed between the sidewalls 21 in parallel with each other.

The covers 13 are provided up and down so as to correspond to the upper and lower faces of the wire cradle 19. The respective covers 13 are rectangular-shaped of the same dimensions as those of the wire cradle 19. The overlapping of the covers 13 on the wire cradle 19 allows the upper and lower faces of the cradle 19 to be closed. In this embodiment, the upper and lower covers 13 are connected with the hood part 24 through hinges 27 on the rear face of the hood part 24. Thus, in the arrangement, the rotation of the hinges 27 causes the wire cradle 19 to be covered with the covers 13. Alternatively, the covers 13 do not have to be connected with the hood part 24 through the hinges 27 and may be constituted by separable members from the hood part 24 in the modification.

Each cover 13 is provided, corresponding to the sidewalls 21 of the cradle 19, with left and right sidewalls 28 having respective tapered faces (second welding sides) 29 and partition walls 30 formed between the sidewalls 28 in parallel with each other. Thus, respective gap portions separated by the respective partition walls 30 and also the sidewalls 28 do constitute second wire accommodating grooves 20*b*. When the wire cradle 19 is covered with the covers 13, the second wire accommodating grooves 20*b* accord with the wire accommodating grooves 20*a* on the cradle's side, respectively. Thus, the respective accordance of the wire accommodating grooves 20*a* with the grooves 20*b* allows wire insertion holes 20 for passing the covered wires 1 to be defined in the connector body 11. Again, the above-mentioned tapered faces 29 are adapted so as to abut against the welding sides 22 of the cradle 19, constituting the second welding sides which are to be welded to the sides 22 by the ultrasonic oscillation.

Figure 3:
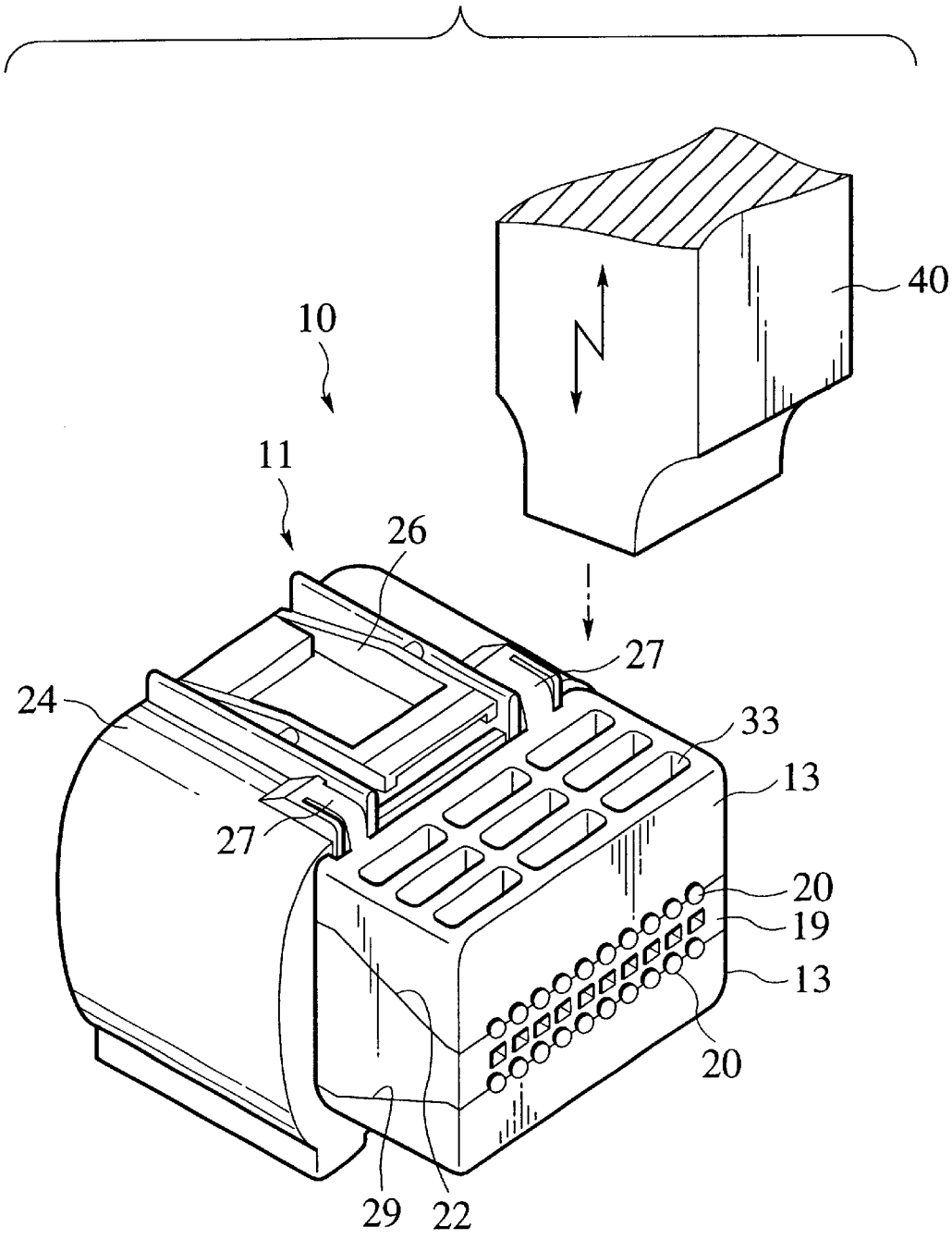
FIG. 3 is a perspective view showing a condition to carry out ultrasonic oscillating.

Each cover 13 is shaped in the form of a block having a cover face 32 for covering the whole face of the wire cradle 19 and provided with a plurality of radiating slots 33 extending from the cover face 32 to the opposite direction of the wire cradle 19. As shown in FIGS. 3, 5 and 6, the plural radiating slots 33 are arranged in the upper and lower vicinities of the wire insertion holes 20 defined by putting the covers 13 on the wire cradle 19.

Penetrating the covers 13 up and down (direction of thickness) but the opposing cover faces 32, the radiating slots 33 are formed so as to open on the respective opposite sides of the cover faces 32. Owing to the provision of the slots 33, it is possible to discharge heat generated by the ultrasonic oscillations to the outside. Note, in each cover 13, its abutment face 13*a* in contact with the hood part 24 is extended in the direction of the wire cradle 19 so as to project into the planes of the terminal accommodating chambers 15, thereby providing a draft-proof engagement part 34 for engagement with the respective rear ends of the terminals 14 accommodated in the terminal accommodating chambers 15. Formed in succession of the draft-proof engagement part 34 is a press part 35 which presses the covered wires 1 in order to bend them in the direction intersecting the axial direction of the wires 1. Thus, owing to so-called "strain-relief" function brought by the part 35, the retaining force for the wires 1 are improved.

As shown in FIG. 1, each terminal 14 includes a crimping part 14*c* where the crimped wire 1 is to be crimped and connected with the terminal 14, a connecting part 14*b* which is to be crimped against the conductor 2 exposed from the covered wire 1 for electrical connection with the conductor 2, and a contact part 14*a* for connection with the mating terminal. The above-mentioned draft-proof engagement part 14 of the cover 13 is adapted so as to engage with the terminal 14 from the rear side of the crimp part 14*c*.

Each covered wire 1 consists of the conductor 2 and the insulating cover part 3 made of resinous material. Preferably, vinyl chloride resin is employed for the material of the cover part 3. Including the housing 12 and the covers 13, the whole waterproof connector 1 may be made of acrylic resin, ABS (acrylonitrile-butadiene-styrene) resin, PC (polycarbonate) resin, polyolefin resin (e.g. polyethylene), PEI (polyether imido) resin, PBT (polybutylene terephthalate) resin, or the like. These resinous materials are characterized in their hardness in comparison with the resin constituting the cover part 3.

As shown in FIG. 1, the wire accommodating grooves 20*a*, 20*b* of the wire cradle 19 and the covers 13 defining the wire insertion holes 20 are constituted by small diametrical grooves 37*a*, 37*b* close to the terminal accommodating chambers 15 and large diametrical grooves 38*a*, 38*b* on the opposite side of the chambers 15, providing so-called two-stage structure. Accordingly, each wire insertion hole 20 resulting from the combination of the wire accommodating groove 20*a* with the wire accommodating groove 20*b* has also two-stage structures where a small aperture part (portion) 37 communicates with a large aperture part (portion) 38.

Figure 4:
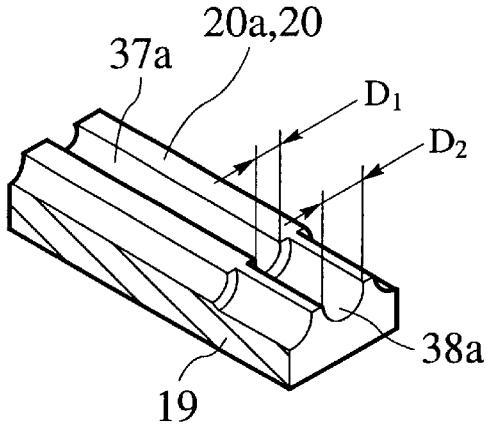
FIG. 4 is a perspective view showing a wire accommodating groove of a wire cradle constituting a wire insertion hole.

Next, the two-stage wire insertion hole 20 will be described in terms of the establishment of dimension. FIG. 4 shows the wire insertion hole 20*a* on the wire cradle 19 in place of the aperture of the wire insertion hole 20. In the figure, D1 denotes an aperture diameter of the small diametrical groove 37*a* (small aperture part 37) and D2 denotes an aperture diameter of the large diametrical groove 38*a* (large aperture part 38).

That is, it is established against the covered wires 1 of different diameters that the aperture diameter D1 is smaller than an outer diameter of the cover part of the thinnest one of the covered wires, while the aperture diameter D2 is equal to or smaller than an outer diameter of the cover part of the thickest one of the covered wires. Additionally, both diameters D1 and D2 are determined so as to allow the conductor of the corresponding covered wire to be inserted into both grooves 37*a* and 38*a*. Accordingly, the diameters D1, D2 are determined as follows:

1̂ a diameter of conductor of the thinnest wire <D1< a diameter of cover part of the thinnest wire 2̂ a diameter of conductor of the thickest wire <D2≦ a diameter of cover part of the thickest wire Owing to the establishment, it is possible to ensure the close contact between the covered wires (from the thinnest covered wire and over) and the wire insertion hole 20 at the small aperture part 37 of the small aperture diameter D1. Therefore, since the cover part 3 of the covered wire 1 is molten and welded at the small aperture part 37 by the ultrasonic oscillation, it is possible to ensure the waterproof capacity at the small aperture part 37.

In order to assemble the waterproof structure of the embodiment, the terminals 14 connected with the covered wires 1 are accommodated in the terminal accommodating chambers 15 in the housing 12 under situation of the opening cover 13, as shown in FIG. 5. With this accommodation, each lance 16 in the terminal accommodating chamber 15 is engaged with the contact part 14*a* of the terminal 14. Note, during this accommodation, the covered wires 1 are lowered into the wire accommodating grooves 20*a* on the wire cradle 19, respectively.

Next, by pivoting the hinges 27, the covers 13 are overlaid on the upper and lower faces of the wire cradle 19. With the action of the covers 13, the welding sides 22 of the wire cradle 19 are brought into close contact with the welding sides 29 of the covers 13 and furthermore, the wire insertion holes 20 as passages for the wires 1 are defined by the wire accommodating grooves 20*a* on the wire cradle 19 and the wire accommodating grooves 20*b* on the cover 13 under the mutual engagement.

As shown in FIG. 6, when overlaying each cover 13 on the cradle 19, the covered wires 1 are bent in a direction of intersecting with the axial direction of the wires since the press part 35 of the cover 13 urges the wires 1 against the wire accommodating grooves 20*a*. Further, the draft-proof engagement part 34 formed on the abutment face 13*a* of each cover 13 engages with respective crimping parts 14*a* of the terminals 14*c* from the rear side.

Next, it is executed to put the lower cover 13 on an anvil (not shown) and abut the upper cover 13 on a horn 40. In this way, while interposing the assembly between the anvil and the horn 40 under pressure, the ultrasonic oscillation (vertical vibrations) is applied on the connector body 11 by the horn 40 (see FIG. 3). By the vertical vibration due to the ultrasonic oscillation, the cover parts 3 in contact with the wire cradle 19 and the covers 13 are firstly molten and thereafter, the cradle 19 and the covers 13 in contact with the covered wires 1 are partially molten.

Since the molten materials in this way are mutually mixed with each other and hardened, there can be formed a resinous binding layer being welded to the covered wires 1, on the boundary between the wire insertion holes 20 and the covered wires 1. Thus, the so-formed layer serves to prevent the water from entering between the wire insertion holes 20 and the covered wires 1, so that the advantageous waterproof structure can be provided. The ultrasonic oscillation is further continued. Consequently, the welding sides 22 of the wire cradle 19 and the welding sides 29 of the covers 13 are molten and welded to each other. In this way, the wire cradle 19 and the covers 13 are combined into one body.

Although the interior of the housing 12 is heated over the melting point of the resinous material due to the ultrasonic oscillation, the resultant heat is radiated by the radiating slots 33 in the covers 13 rapidly. Therefore, even if crystalline resin such as PBT is used, it is possible to restrict the solidification of resinous material, which is caused by the crystallization progressed by heat, and the corresponding reduction in toughness of the resinous material to the minimum.

In addition, with the arrangement where the radiating slots are formed in the vicinity of the wire insertion holes 20, even if the cover parts 3 are molten in the wire insertion holes 20 by the ultrasonic oscillation, the rapid radiation can be accomplished to shorten the hardening period of the molten parts 3. Consequently, it is possible to transfer the resultant connector to the next process rapidly.

Figure 7A:
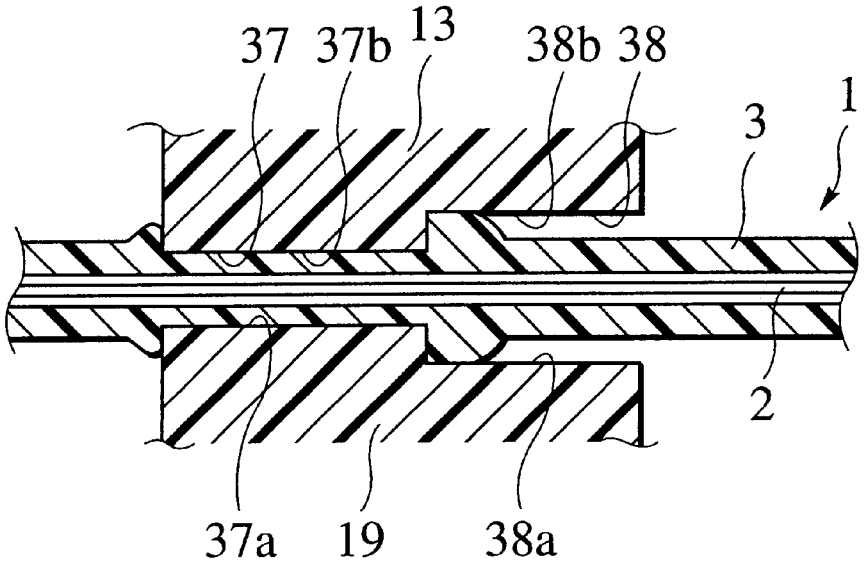
FIG. 7A is a cross sectional view for explanation of the function of the two-stage wire insertion hole on the thinnest covered wire.
Figure 7B:
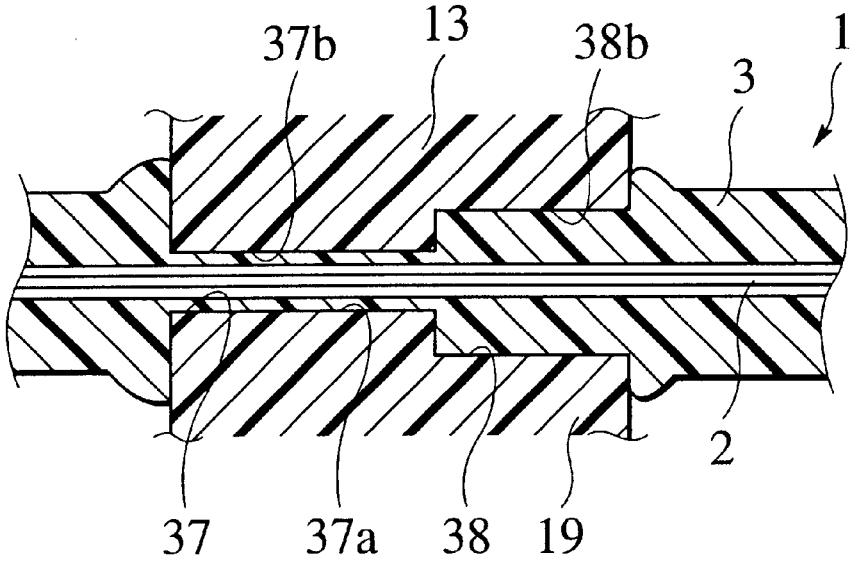
FIG. 7B is a cross sectional view for explanation of the function of the two-stage wire insertion hole on the thickest covered wire.

FIGS. 7A and 7B are provided for explanation of the function of the above-mentioned wire insertion hole 20. In the figures, FIG. 7A shows the thinnest covered wire 1, while FIG. 7B shows the thickest covered wire 1. In case of the thinnest wire 1, as shown in FIG. 7A, the small aperture part 37 of the wire insertion hole 20 comes into close contact with the cover part 3 of the wire 1. Additionally, since the small aperture part 37 is smaller than the cover part 3 in diameter, the part 3 is depressed by the small aperture part 37. Thus, the cover part 3 swells somewhat on both sides of the small aperture part 37. When applying the ultrasonic oscillation under such a situation, the molten cover part 3 is welded to the cradle 19 and the cover 13 along the longitudinal direction of the small aperture part 37. Therefore, the waterproof structure will be accomplished certainly even if the thin covered wires are used.

In case of the thickest wire 1, as shown in FIG. 7B, not only does the small aperture part 37 come into close contact with the cover part 3 but the large aperture part 38 does. Therefore, the cover part 3 is welded to the cradle 19 and the cover 13 over the full length of the wire insertion hole 20, providing the waterproof capability.

In case of the thickest covered wire 3, the wire cradle 19 and the cover 13 do not stick to each other in the initial stage because of largeness in diameter of the cover part 3. However, since the cover part 3 is molten while decreasing the thickness owing to the ultrasonic oscillation under pressure, the wire cradle 19 is brought into close contact with the cover 13 finally. Thus, as a result, it is possible to weld the wire cradle 19 to the cover 13 certainly.

Note, even if using the covered wire having a medium thickness between the above-mentioned thinnest and thickest thickness, the waterproof capability can be ensured at the small aperture part 37 since the cover part 3 comes into close contact with the part 37, as similar to the arrangement of FIG. 7A. Consequently, the above-mentioned waterproof structure of the invention is applicable to the covered wires of different diameters, providing the general purpose waterproof connector in terms of the diameter of the covered wire.

Figure 8:
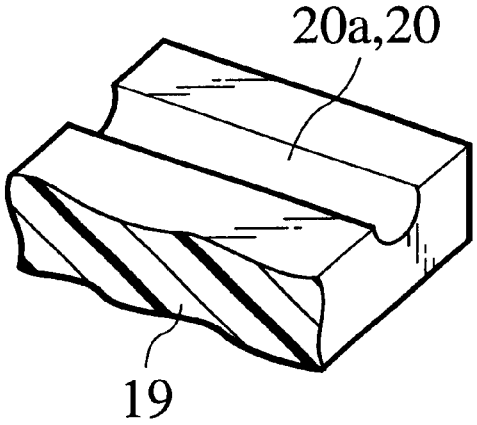
FIG. 8 is a perspective view showing the wire insertion hole having an aperture of a single diameter.
Figure 9:
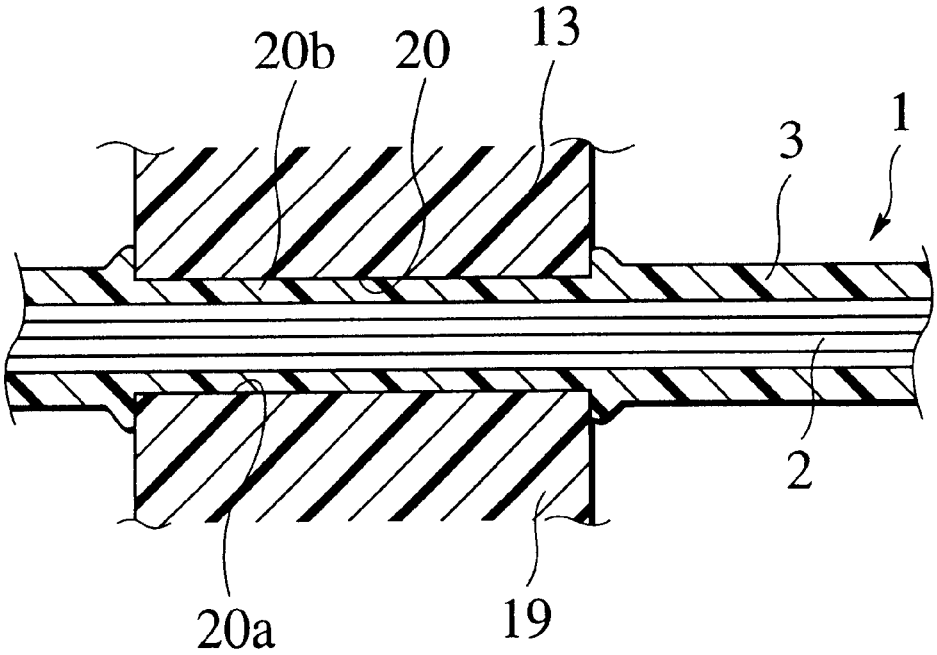
FIG. 9 is a cross sectional view for explanation of the function of the wire insertion hole having the aperture of the single diameter.

FIGS. 8 and 9 show the wire insertion hole 20 having an aperture of a single diameter. In this case, the aperture diameter is established smaller than the outer diameter of the cover part 3 of the thinnest covered wire 1. Owing to this establishment, as shown in FIG. 9, the wire insertion hole 20 is capable of fitting the cover parts of the covered wires of different diameters, from the thinnest covered wire, closely. Therefore, since the molten cover part 3 resulting from the ultrasonic oscillation under pressure is welded to the wire insertion hole 3, it is possible to ensure the waterproof capability. Also in this case, since the wire cradle 19 adheres to the covers 13 as the diameter of the cover part 3 decreases, it is possible to weld the cradle 19 to the covers 13 into one body.

Figure 10:
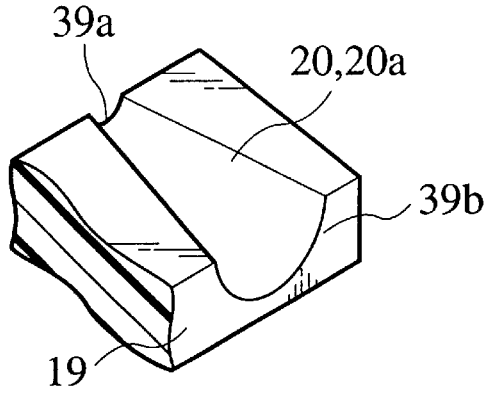
FIG. 10 is a perspective view showing the wire insertion hole having a tapered aperture.
Figure 11A:
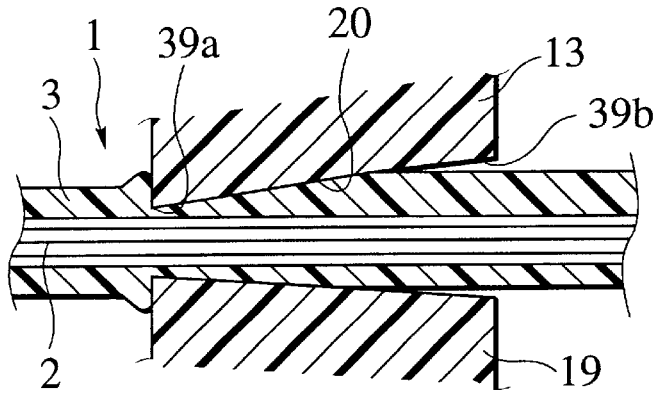
FIG. 11A is a cross sectional view for explanation of the function of the wire insertion hole having the tapered aperture in case of the thinnest covered wire.
Figure 11B:
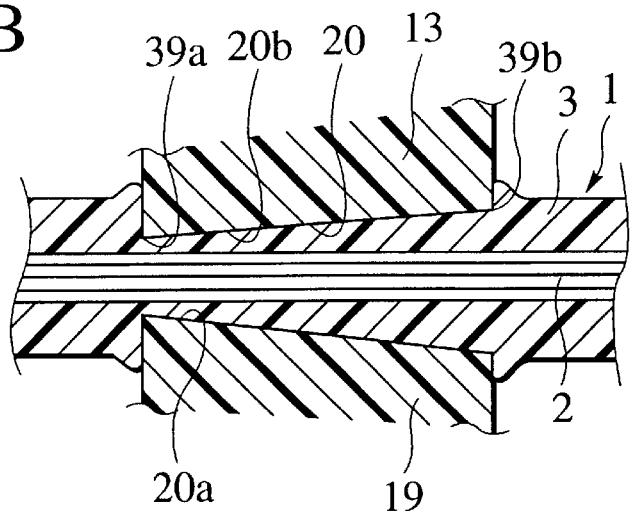
FIG. 11B is a cross sectional view for explanation of the function of the wire insertion hole having the tapered aperture in case of the thickest covered wire.

FIGS. 10, 11A and 11B show the wire insertion hole 20 having a tapered aperture. In detail, the wire insertion hole 20 (wire accommodating groove 20*a*) is contoured so as to have diameters which continuously vary from a small diametrical part 39*a* on one end to a large diametrical part 39*b* on the opposite end. Note, the small diametrical part 39*a* is established smaller than the outer diameter of the cover part of the thinnest covered wire, while the large diametrical part 39*b* is established equal to or smaller than the outer diameter of the cover part of the thickest covered wire.

In this case, since the small diametrical part 39*a* comes into close contact with the cover part of the thinnest covered wire molten cover part 3, the wire insertion hole 20 is capable of sticking to the covered wire having a thickness more than the cover part of the thinnest covered wire, whereby the waterproof capability can be ensured. Additionally, even if the covered wire is too thick, it is possible to weld the cradle 19 to the covers 13 into one body since the diameter of the cover part 3 decreases due to the melting of the cover part 3 by the ultrasonic oscillation under pressure.

Finally, it will be understood by those skilled in the art that the foregoing description is related to one preferred embodiment of the disclosed waterproof connector and that various changes and modifications may be made to the present invention without departing from the spirit and scope thereof.

What is claimed is:

1. A waterproof connector for a plurality of covered wires having conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes is provided with an aperture portion capable of close contact with the cover part of a thinnest one of the covered wires having plural different diameters;

whereby at least the aperture portion of each of the wire insertion holes is welded to the cover parts of the covered wires.

2. The waterproof connector as claimed in claim 1, wherein each of the wire insertion holes is formed to have a single diameter smaller than an outer diameter of the cover part of the thinnest covered wire.

3. The waterproof connector as claimed in claim 1, wherein the connector body has a wire cradle, the wire cradle having first welding sides and a plurality of first wire accommodating grooves, and a cover to be overlaid on the wire cradle, the cover having second welding sides to be welded to the first welding sides and second wire accommodating grooves to be agreed with the first accommodating grooves thereby to define the wire insertion holes.

4. A waterproof connector for a plurality of covered wires having conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes comprises at least two aperture portions of different diameters, an aperture portion of smaller diameter being formed to have a diameter smaller than an outer diameter of the cover part of the thinnest covered wire, an aperture portion of larger diameter being formed to have a diameter equal to or smaller than an outer diameter of the cover part of the thickest covered wire, whereby at least the aperture portion of each of the wire insertion holes is welded to the cover parts of the covered wires.

5. A waterproof connector for a plurality of covered wires having conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes is tapered so as to have diameters which continuously vary from a small diameter, which is smaller than an outer diameter of the cover part of the thinnest covered wire, to a large diameter, which is equal to or smaller than an outer diameter of the cover part of the thickest covered wire, along the axial direction of the covered wire, whereby at least the aperture portion of each of the wire insertion holes is welded to the cover parts of the covered wires.

6. A waterproof connector for a plurality of covered wires having, conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes is provided with an aperture portion capable of close contact with the cover part of a thinnest one of the covered wires having plural different diameters;

whereby at least the aperture portion of each of the wire insertion holes is welded to the cover parts of the covered wires, wherein the connector body is provided, in the vicinity of the wire insertion holes, with radiating slots for discharge heat generated at the time of ultrasonic oscillating.

7. A waterproof connector for a plurality of covered wires having conductors covered with cover parts of resinous material, the waterproof connector comprising:

a connector body;

a plurality of terminal accommodating chambers formed in the connector body, for accommodating a plurality of terminals therein;

a plurality of wire insertion holes defined in the connector body so as to communicate with the terminal accommodating chambers, respectively; and a waterproof structure provided by firstly inserting the covered wires being respectively connected with the terminals into the wire insertion holes and secondly welding the cover parts of the covered wires to the wire insertion holes by ultrasonic oscillating under pressure from an outside of the connector body;

wherein each of the wire insertion holes is provided with an aperture portion capable of close contact with the cover part of a thinnest one of the covered wires having plural different diameters;

whereby at least the aperture portion of each of the wire insertion holes is welded to the cover parts of the covered wires, wherein the connector body has a wire cradle, the wire cradle having first welding sides and a plurality of first wire accommodating grooves, and a cover to be overlaid on the wire cradle, the cover having second welding sides to be welded to the first welding sides and second wire accommodating grooves to be agreed with the first accommodating grooves thereby to define the wire insertion holes, wherein the cover is provided, along a thickness direction thereof, with radiating slots for discharge heat generated at the time of ultrasonic oscillating.

* * * * *